US006000405A

United States Patent [19]

De Laforcade

[11] Patent Number: 6,000,405

[45] Date of Patent: Dec. 14, 1999

[54] DISPENSING HEAD FOR DISPENSING PRODUCT FROM A RESERVOIR

[75] Inventor: Vincent De Laforcade, Rambouillet, France

[73] Assignee: L'Oréal S.A., Paris, France

[21] Appl. No.: 09/274,381

[22] Filed: Mar. 23, 1999

[30] Foreign Application Priority Data

Mar. 24, 1998 [FR] France ..... 98 03600

[51] Int. Cl.[6] ..... A45D 24/22

[52] U.S. Cl. ..... 132/116; 132/112; 401/190; 222/192

[58] Field of Search ..... 132/112, 113, 132/114, 115, 116, 207, 208, 212, 120, 313; 401/190, 290, 272, 289; 222/192, 402.1, 402.12, 402.21

[56] References Cited

U.S. PATENT DOCUMENTS

| | | | |
|---|---|---|---|
| 3,961,635 | 6/1976 | Miya . | |
| 4,067,482 | 1/1978 | Vogel et al. | 222/402.12 |
| 4,533,273 | 8/1985 | Obata et al. . | |
| 4,938,621 | 7/1990 | Pyrozyk | 132/112 |
| 5,000,199 | 3/1991 | Kuranski et al. | 132/112 |
| 5,024,243 | 6/1991 | Snyder | 132/116 |
| 5,624,055 | 4/1997 | Clanet et al. | 222/402.12 |

FOREIGN PATENT DOCUMENTS 0 223 418 5/1987 European Pat. Off. .

*Primary Examiner*—Gene Mancene
*Assistant Examiner*—Pedro Philogene
*Attorney, Agent, or Firm*—Finnegan, Henderson, Farabow, Garrett & Dunner, L.L.P.

[57] ABSTRACT

A dispensing head for dispensing product from a reservoir having at least one of a pump and a valve includes a body configured to be mounted on the reservoir and a movable portion connected to the body by a hinge permitting pivotal movement of the movable portion during displacement of an actuating surface on the movable portion. The movable portion is configured to actuate the at least one pump and valve in response to the pivotal movement and includes an applicator capable of receiving product from the reservoir when the at least one pump and valve is actuated. The dispensing head also includes a guide configured to substantially limit movement of the movable portion to the pivotal movement about the hinge.

26 Claims, 2 Drawing Sheets

DISPENSING HEAD FOR DISPENSING PRODUCT FROM A RESERVOIR

FIELD OF THE INVENTION

The present invention relates to a dispensing head for dispensing product from a reservoir and for applying the product. Preferably, the product is a hair-care product, for example, a hair tinting product in the form of a mousse. The invention also relates to a product dispenser including the dispensing head and the reservoir.

BACKGROUND OF THE INVENTION

In the field of hair tinting, there is a need for dispensing heads that function in combination with a reservoir for applying hair products. Such a need exists, in particular, for the application of tinting products that come in the form of a mousse, cream, or gel.

Differing types of dispensing heads that fit on aerosol cans or containers equipped with pumps are known in the art. One type of dispensing head includes an applicator having bristles or teeth. The bristles or teeth have supply channels inside them for passing fluid onto the applicating surface of the applicator. Some prior dispensing heads with this configuration are simple and economical, but unacceptably fragile. Other conventional dispensing heads are sturdy, but complicated and costly due to the large number of component parts necessary to make these dispensing heads. Prior dispensing heads have failed to satisfy the need for a strong, sturdy dispensing head that is cost efficient and profitable to sell on the market.

One explanation for the failure of prior designs to satisfy these needs relates to the configuration of the reservoirs that function with dispensing heads. In particular, for aerosol containers having a conventional push-button and valve dispensing element, the push-button and valve is movable either in a direction parallel to the axial plane of the button (in the case of a depression valve) or in a direction perpendicular to the axial plane of the button (in the case of a tilting valve). Designing a dispensing head that accommodates these operational requirements, while remaining sturdy and economical, has proved difficult.

Two types of dispensing head configurations that function with a push-button and valve are known in the art. The first is a one-piece structure, wherein the dispensing head is integral with the movable part of the push-button. Prior dispensing heads with an integral configuration have demonstrated a superior seal over multi-piece dispensing heads, but have proved unacceptably fragile. More specifically, for aerosol containers with a depression valve, the connector between the movable part of the push-button and the fixed body of the push-button is generally a film hinge. A film hinge performs well when stressed about its axis of rotation, but when forces are applied in other directions, it is subjected to considerable torsional stresses. These stresses can tear the film hinge, rendering the entire dispensing head unusable. For example, when applying product using the applicator, a "knot" (i.e., tangle) in the hair may force the film hinge to move in a direction other than about its hinge axis, thereby tearing the film hinge.

The other conventional dispensing head design involves a complex structure that fixes the dispensing head with respect to the container. The complexity of this configuration arises from the need to afford the necessary freedom of movement for the push-button and valve, while still providing a sealed connection between the reservoir and the dispensing head. Prior dispensing head designs using multi-component configurations have demonstrated unacceptably high manufacturing cost and have proved to be unprofitable.

Prior designs also suffer from the problem of inadvertent dispensing of product. More specifically, when applying product to the hair using prior designs for dispensing heads, "knots" in the hair can cause inadvertent actuation of the reservoir valve, thereby dispensing unwanted product onto the dispensing head and the hair. If the product is a hair tint, applying too much product to the hair can produce an unacceptable result. In addition, dispensing excessive product can result in product dropping onto the floor or falling onto the user's shoulders, both of which are undesirable.

In light of the foregoing, there is a need in the art for an improved dispensing head.

SUMMARY OF THE INVENTION

Accordingly, the present invention is directed to a dispensing head that obviates one or more of the short-comings of the related art.

A preferred object of the invention is to provide a dispensing head that is both sturdy and cost efficient to produce.

Another preferred object of the invention is to provide a molded, one-piece dispensing head that is convenient to use, sturdy, and has an economically acceptable cost.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a dispensing head for dispensing a product from a reservoir including at least one of a pump and a valve. The dispensing head comprises a body configured to be mounted on the reservoir and a movable portion connected to the body by a hinge permitting pivotal movement of the movable portion during displacement of an actuating surface on the movable portion. The movable portion is configured to actuate the at least one pump and valve in response to the pivotal movement and includes an applicator capable of receiving product from the reservoir when the at least one pump and valve is actuated. The dispensing head also includes a guide configured to substantially limit movement of the movable portion to the pivotal movement about the hinge.

By limiting the movement of the movable portion, the guide substantially prevents tearing of the hinge when the movable portion is snagged, for example, by a "knot" in the hair. In particular, when the movable portion is forced to move in a direction other than about the hinge axis, it comes into contact with the guide. By constraining the movement of the movable portion, the guide relieves the stress from the hinge and reduces the risk of damaging the dispensing head.

Preferably, the movable portion includes an arm with the applicator mounted on one end thereof. The guide preferably includes two support members located on opposite sides of the arm. Preferably, the height of the support members is from approximately ¼ to approximately ¾ of the axial height of the arm. More preferably, the height of the support members is from approximately ½ to approximately ¾ of the axial height of the arm. Each support member preferably has an inner face arranged adjacent to a corresponding one of the opposite sides of the arm and substantially perpendicular to the hinge axis of the hinge. In a preferred embodiment, each support member also includes an outer portion having a rounded profile.

Preferably, the applicator is a brush including a base and a plurality of brush members extending from the base. Although the base may be of any shape, the base preferably has an oval shaped outer profile. Preferably, the brush members are substantially perpendicular to an axis of the head and also substantially perpendicular to an axis of the reservoir when the body is mounted on the reservoir. The brush members are preferably chosen from bristles and teeth.

Preferably, the movable portion includes a product flow channel having an outlet in the base. The product flow channel is preferably capable of being placed in flow communication with the reservoir during actuation of the at least one valve and pump. Preferably, the outlet is partially obstructed by a diffusion member, such as a screen or porous (e.g., sintered) member. Obstructing the outlet permits better expansion or swelling of the product as it is dispensed, creating better distribution of the product on the applicator especially when the product is a mousse.

The hinge is preferably a thin, flexible film of material. The use of a film hinge permits the production of a single-piece, integral dispensing head. Preferably, the entire dispensing head, including the film hinge, is manufactured from thermoplastic material. In a preferred embodiment, the thermoplastic material is chosen from a low cost polyethylene and polypropylene.

Preferably, the body includes a coupler for securing the dispensing head on the reservoir. For example, the coupler may include a flange that is capable of snap-fitting with a second flange formed by a collar crimping the valve of the reservoir. In the alternative, the coupler may include a flange that is capable of snap-fitting in an annular groove provided on the upper part of a reservoir. One of ordinary skill in the art will recognize that other, conventional techniques could be used for securing the dispensing head on the reservoir.

In another aspect, the invention includes a product dispenser for dispensing a product. The product dispenser includes a reservoir for holding product, at least one of a pump and a valve on an upper portion of the reservoir, and one of the dispensing heads described above on the upper portion of the reservoir. When a valve is used, the product can be pressurized inside the reservoir by means of liquefiable or non-liquefiable gases. For example, the gas may be chosen from nitrogen, a mixture of propane and butane, compressed air, nitrogen monoxide, carbon dioxide, and freons.

In another aspect, the invention includes the product dispenser described above in combination with a product packaged inside of the reservoir. Preferably, the product is a hair-care product. More preferably, the hair-care product is for tinting the hair and is in the form of a mousse.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
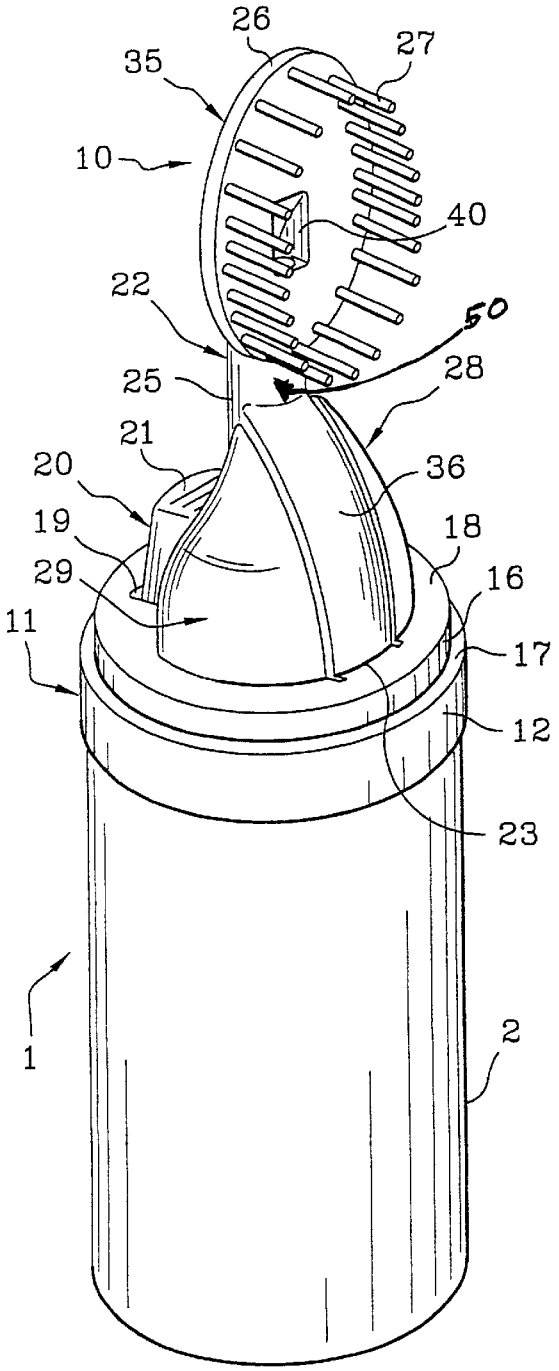
FIG. 1 is a perspective view showing an embodiment of a dispensing head on top of a reservoir according to the present invention.

Reference will now be made in detail to the present preferred embodiments of the invention, examples of which are illustrated in the accompanying drawings. Wherever possible, the same reference numbers are used in the drawings and the description to refer to the same or like parts.

Referring to FIGS. 1, 2, and 3A–3C, a dispensing head 10 includes a body 11 configured to be mounted on top of a reservoir 2 and a movable portion 22 connected to the body 11 via a hinge 23 permitting pivotal movement of the movable portion 22 about an axis of the hinge 23. The movable portion 22 includes an actuating member 20, an arm 25, and an applicator 35. Preferably, the actuating member 20, the arm 25, the applicator 35, and, optionally, also the body 11 are constructed in an integral, one piece configuration. The applicator 35 includes a base 26 and brush members 27. The brush members 27 are preferably bristles or teeth oriented perpendicular to an axis X of the reservoir 2. The actuating member 20 has an actuating surface 21, which forms a bearing surface for actuation of a pump and/or valve 41 located on the reservoir. Preferably, the outer profile of the base 26 has a substantially oval shape.

The arm 25 of the movable portion 22 includes a product flow channel 24. The product flow channel 24 extends along the entire length of the arm 25 and opens into an outlet 40 located in the base 26. Preferably, the outlet 40 is partially obstructed by a deflecting member, such as a screen (not shown), to create better spreading of the product over the brush members 27 as the product is dispensed, especially when the product is a mousse.

The body 11 includes a first cylindrical skirt 12 and a second cylindrical skirt 16 of a smaller diameter than the first cylindrical skirt 12. The first cylindrical skirt 12 is connected to the second cylindrical skirt 16 via a shoulder 17. A transverse wall 18 is connected to the second cylindrical skirt 16 on the end opposite to the shoulder 17. The transverse wall 18 has a cut-out 19, shown in FIGS. 1, 3A and 3C, corresponding to the shape of the actuating member 20.

Figure 2:
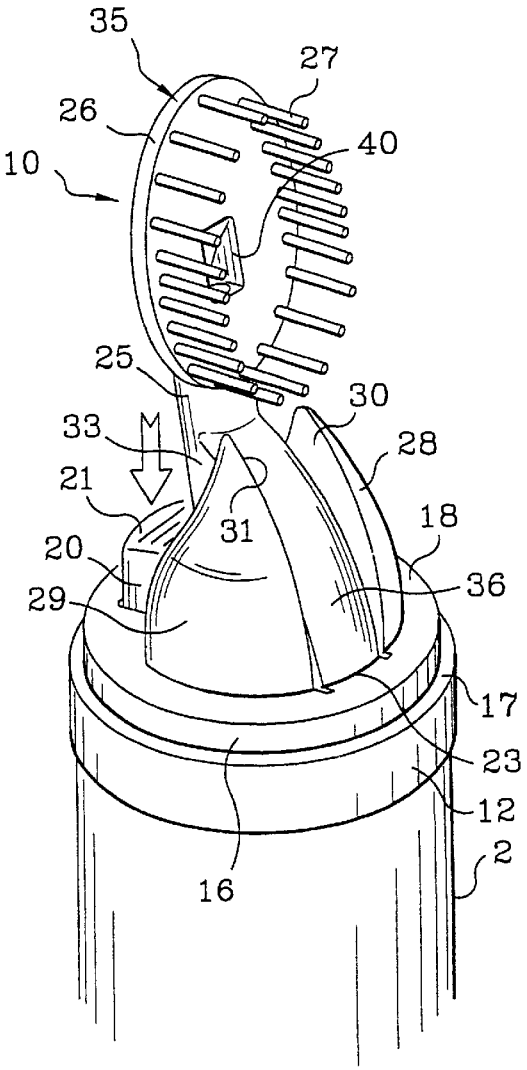
FIG. 2 is a view showing the dispensing head of FIG. 1 with the movable portion pivoted to actuate the valve.

The body 11 also includes a guide preferably including a first support member 28 and a second support member 29 configured to substantially limit movement of the movable portion 22 to pivotal movement about a hinge axis of the hinge 23. As shown in FIGS. 2 and 3B, the support members 28, 29 have inner faces 30, 31, which are located adjacent to sides 32, 33 of the arm 25, respectively. The support members 28, 29 also have outer portions 37, 38, which preferably have a rounded profile. The ratio of the height of the support members 28, 29 to the axial height of the arm 25 is preferably from approximately ¼ to approximately ¾, more preferably from approximately ½ to approximately ¾, and most preferably approximately ½.

As shown in FIG. 3B, the inner faces 30, 31 are arranged in respective planes substantially perpendicular to the hinge axis defined by the hinge 23. Although the support members 28, 29 substantially limit movement of the movable portion 22 to pivotal movement about the hinge 23, there are small gaps between the sides 32, 33 of the arm 25 and the inner faces 30, 31, respectively. Preferably, each gap is from approximately 0.5 mm to approximately 1 mm. Because of these gaps, the support members 28, 29 do not contact the arm 25 or otherwise impede the dispensing process unless a lateral or torsional force is applied to the movable portion 22. Although the preferred embodiment employs two support members 28, 29 as a guide, one of ordinary skill in the art will recognize that other guiding configurations could be used to practice the invention.

As shown in FIG. 1, the hinge 23 connects the transverse wall 18 of the base 11 to one end of a junction 36. The other end of the junction 36 is connected to the arm 25 on its front side 50. The junction 36 is connected to the arm 25 at a height slightly above the height of the support members 28, 29. Preferably, the junction 36 is curved so that when the dispensing head 10 is at rest, as shown in FIG. 1, the junction 36 and the outer portions 37, 38 of the support members 28, 29 form a substantially continuous surface.

Figure 3A:
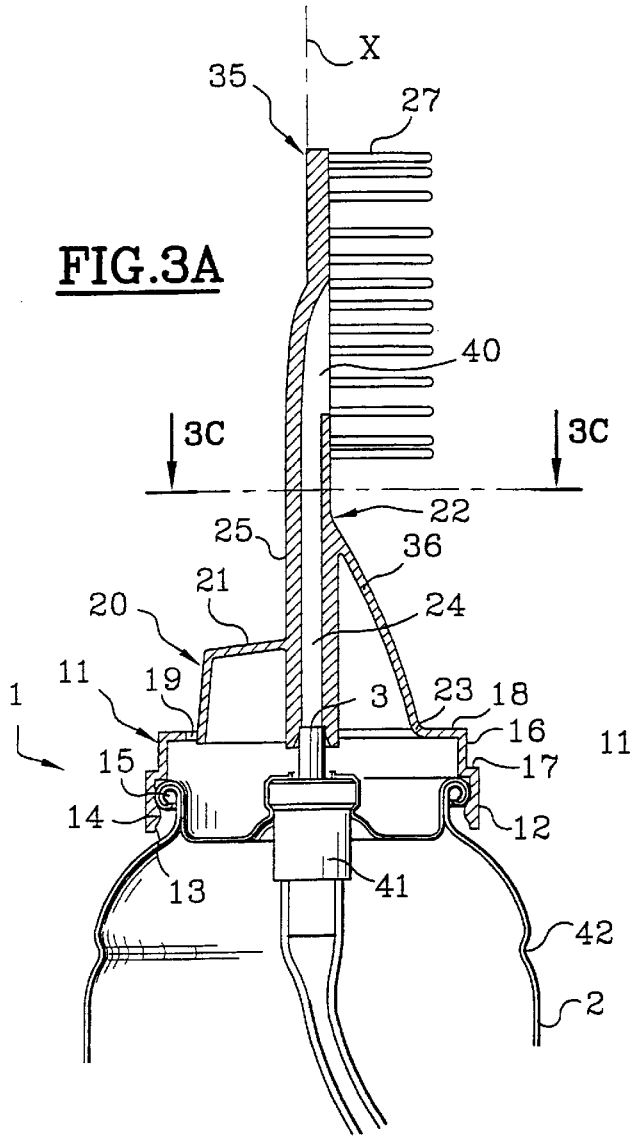
FIG. 3A is a side cross-sectional view of the dispensing head and an upper portion of the reservoir of FIG. 1.
Figure 3B:
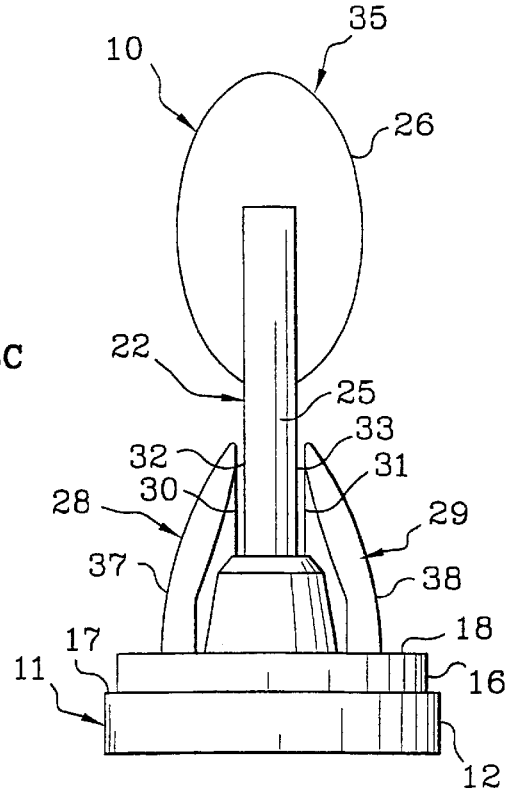
FIG. 3B is a partial rear view of the dispensing head of FIG. 1.
Figure 3C:
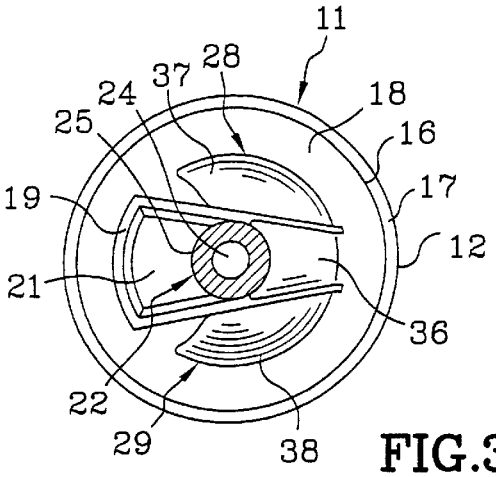
FIG. 3C is a cross-sectional view taken along line 3C—3C of FIG. 3A.

In the preferred embodiment shown in FIG. 3A, the reservoir 2 is an aerosol can having a depression-type valve 41 with a protruding valve stem 3 on top of the reservoir 2. The reservoir 2 has a collar 15 crimped on the valve 41. The product flow channel 24 of the arm 25 is configured to be force fit on the valve stem 3 of the reservoir 2. The cylindrical skirt 12 of the body 11 has an inner wall 13 with a protrusion 14. The protrusion 14 is configured to snap-fit the dispensing head 10 onto the collar 15 of the reservoir 2. Additionally, on the upper portion of the reservoir 2, there is a groove 42, as shown in FIG. 3A, for removably mounting a protective cap (not shown) over the dispensing head 10.

To apply product to the hair, the user actuates the valve 41 of the reservoir 2 by applying pressure to the actuating surface 21, which causes the movable part 22 to tilt about the hinge axis of the hinge 23, as shown in FIG. 2. This movement, in turn, causes a downward motion of the valve stem 3, thereby actuating the valve 41 and releasing product from the valve stem 3 into the product flow channel 24. The released product proceeds through the product flow channel 24, out from the outlet 40, and then onto the applicator 35. Preferably, enough product is released to substantially fill the entire volume defined by the brush members 27.

Thereafter, similar to the use of a conventional brush, the user places the applicator 35 on the hair, and moves the applicator 35 across the hair to apply the product at the desired locations. If the applicator 35 encounters a "knot" in the hair (or any other obstacle) during its movement across the hair, the arm 25 will come into contact with at least one of the inner faces 30, 31 of the support members 28, 29, thereby substantially preventing damage to the hinge 23. The support members 28, 29 also help to prevent inadvertent actuation of the valve 41 when the applicator 35 encounters such an obstacle. It should be noted that because of the presence of the small gaps between the arm 25 and the support members 28, 29, the support members 28, 29 do not impede the pivotal movement of the movable portion 22 during normal operation of the dispensing head 10.

It will be apparent to those skilled in the art that various modifications and variations can be made to the structure of the present invention without departing from the scope or spirit of the claimed invention. For example, the dispensing head may be used with a reservoir having a tilting-type valve or a pump and pump-rod configuration. Likewise, one could manufacture the dispensing head using multiple components that are assembled by snap-fitting or adhesive, for example, without departing from the scope of the claimed invention. The use of a multi-component configuration would permit greater flexibility in the design of the applicator, as well as allow the use of less costly molds.

In view of the foregoing, it is intended that the present invention cover modifications and variations of this invention, provided they fall within the scope of the following claims and their equivalents.

What is claimed is:

1. A dispensing head for dispensing a product from a reservoir including at least one of a pump and a valve, the dispensing head comprising:

a body configured to be mounted on the reservoir;

a movable portion connected to the body by a hinge permitting pivotal movement of the movable portion during displacement of an actuating surface on the movable portion, the movable portion being configured to actuate said at least one pump and valve in response to the pivotal movement, and the movable portion including an applicator capable of receiving the product from the reservoir when said at least one pump and valve is actuated; and a guide configured to substantially limit movement of the movable portion to the pivotal movement about the hinge axis.

2. The dispensing head of claim 1, wherein the movable portion includes an arm and wherein the applicator is on an end of an arm.

3. The dispensing head of claim 2, wherein the guide includes two support members located on opposite sides of the arm.

4. The dispensing head of claim 3, wherein the height of the support members is from approximately ¼ of the axial height of the arm to approximately ¾ of the axial height of the arm.

5. The dispensing head of claim 3, wherein the height of the support members is from approximately ½ of the axial height of the arm to approximately ¾ of the axial height of the arm.

6. The dispensing head of claim 3, wherein each support member includes an inner face and an outer portion, each inner face being adjacent to a respective one of the opposite sides of the arm.

7. The dispensing head of claim 6, wherein the outer portions of the support members have a rounded profile.

8. The dispensing head of claim 6, wherein the inner faces of the support members are substantially perpendicular to the hinge axis of the hinge.

9. The dispensing head of claim 1, wherein the applicator is a brush including a base and a plurality of brush members extending from the base, the brush members being substantially perpendicular to an axis of the reservoir when the body is mounted on the reservoir.

10. The dispensing head of claim 9, wherein the movable portion includes a product flow channel having an outlet in the base, the product flow channel being capable of being placed in flow communication with the reservoir during actuation of said at least one valve and pump.

11. The dispensing head of claim 9, wherein the brush members are bristles.

12. The dispensing head of claim 9, wherein the brush members are teeth.

13. The dispensing head of claim 1, wherein the hinge is a thin, flexible film of material.

14. The dispensing head of claim 13, wherein the material is a thermoplastic material.

15. The dispensing head of claim 14, wherein the thermoplastic material is chosen from polyethylenes and polypropylenes.

16. The dispensing head of claim 1, wherein the body includes a coupler for securing the head on the reservoir.

17. The dispensing head of claim 16, wherein the coupler is a flange configured to engage a collar on the reservoir.

18. A product dispenser for dispensing product, comprising:

a reservoir for containing the product;

at least one of a pump and a valve on an upper portion of the reservoir; and the dispensing head of claim 1 on the upper portion of the reservoir.

19. The product dispenser of claim 18, further comprising a product contained in the reservoir.

20. The product dispenser of claim 19, wherein the product is a hair treatment product.

21. The product dispenser of claim 20, wherein the product is a product capable of tinting the hair.

22. The dispensing head of claim 9, wherein the base has a substantially oval shaped outer profile.

23. The dispensing head of claim 10, further comprising a deflecting member covering the outlet.

24. The dispensing head of claim 23, wherein the deflecting member is a screen.

25. The dispensing head of claim 1, wherein the body, the movable portion, and the guide comprise a plurality of separate sub-units connected together.

26. The dispensing head of claim 25, wherein the sub-units are connected together by at least on of snap-fitting and adhesive.

* * * * *